US006880828B2

(12) United States Patent
Liao

(10) Patent No.: US 6,880,828 B2
(45) Date of Patent: Apr. 19, 2005

(54) ADJUSTING DEVICE FOR BOUNCING NET DEVICES

(76) Inventor: Grace Liao, 9F, No. 196, Ming-Sheng Rd., Hsinchu City (TW)

( * ) Notice: Subject to any disclaimer, the term of this patent is extended or adjusted under 35 U.S.C. 154(b) by 144 days.

(21) Appl. No.: 10/347,250

(22) Filed: Jan. 21, 2003

(65) Prior Publication Data

US 2004/0140621 A1 Jul. 22, 2004

(51) Int. Cl.[7] ..... A63B 63/00
(52) U.S. Cl. ..... 273/395; 273/407; 473/435
(58) Field of Search ..... 273/395, 396, 273/398–402; 473/434, 435, 476, 478

(56) References Cited

U.S. PATENT DOCUMENTS 3,087,701 A * 4/1963 Wallace ..... 248/166
3,456,945 A * 7/1969 Epply ..... 473/435
3,836,144 A * 9/1974 Mahoney ..... 473/435
4,457,513 A * 7/1984 Thompson ..... 473/469
4,553,751 A * 11/1985 Ketchum ..... 473/435
4,650,189 A * 3/1987 Rajacich ..... 473/434
5,584,480 A * 12/1996 Grimsrud ..... 473/416
5,772,537 A * 6/1998 Anderson et al. ..... 473/435
5,833,234 A * 11/1998 Vavala et al. ..... 473/434
5,906,552 A * 5/1999 Padilla ..... 473/421
6,319,145 B1 * 11/2001 Coughlan ..... 473/197
2003/0236139 A1 * 12/2003 Jensen et al. ..... 473/434

* cited by examiner

*Primary Examiner*—Mark S. Graham
(74) *Attorney, Agent, or Firm*—Birch, Stewart, Kolasch & Birch, LLP

(57) ABSTRACT

A bouncing net device includes two connection members each composed of two identical parts and three tubes are pivotably connected between the two parts. Each of the connection members has three sets of positioning holes which are located around positions where the three tubes are pivotably connected to the connection member. Three frames are respectively connected between the three tubes on the two connection members. Two covers are pivotably connected to two sides of one of the two parts and connected between the two parts. The three tubes are pivotable relative to the connection members so as to adjust the orientations of the frames. The covers prevent the tubes from pivoted suddenly when folding to avoid hurting the users.

6 Claims, 9 Drawing Sheets

ADJUSTING DEVICE FOR BOUNCING NET DEVICES

FIELD OF THE INVENTION

The present invention relates to a bouncing net device including two connection members with which three tubes are pivotably connected. The connection member includes a plurality of positioning holes so as to position the tubes and the frames connected between the tubes at different positions.

BACKGROUND OF THE INVENTION

A conventional bouncing net device is shown in FIG. 9 and generally includes a leg portion composed of two wide opened leg frames. An upright frame is pivotably connected between the two leg frames. A net is tightly connected to the upright frame and the two leg frames such that the players may hit balls into the net and catch the ball bounced from the net. The balls bounce from the net in different angles and directions according to the way that the balls are shot at the bouncing net device so that the players try to catch the balls in different ways. Nevertheless, the frame is heavy so that the orientation of the frame and the net cannot be adjusted to meet the needs of the players. Although some brands of the bouncing net devices have an adjustable frame, they have potential risks when adjusting the frame because the tension force that the net applies to the frame is huge so that the frame could move fast and hurt the people beside the frame.

The present invention intends to provide a bouncing net device that has a foldable frame including two connection members which allow the frame to be positioned in various positions. Two protection covers are connected to the connection members to prevent the frames from being pivoted and hurting the people folding the frame.

SUMMARY OF THE INVENTION

In accordance with one aspect of the present invention, there is provided a bouncing net device which comprises two connection members each comprising two identical parts and three tubes are pivotably connected between the two parts. Three sets of positioning holes are located around positions where the three tubes are pivotably connected to the connection member. Three frames are respectively connected between the three tubes on the two connection members. Two covers are pivotably connected to two sides of one of the two parts and cover up a gap between the two parts.

The present invention will become more obvious from the following description when taken in connection with the accompanying drawings which show, for purposes of illustration only, a preferred embodiment in accordance with the present invention.

DETAILED DESCRIPTION OF THE INVENTION

Referring to FIGS. 1 to 4, the bouncing net device of the present invention comprises two connection members 1 each comprising two identical parts 2. Each of the two parts 2 include two side wings which are inclined downward from a peak portion. Three connection holes 21, 22, 23 are respectively defined in the peak portion and the two side wings. Three sets of positioning holes 24, 25, 26 are located around the connection holes 21, 22, 23.

Figure 1:
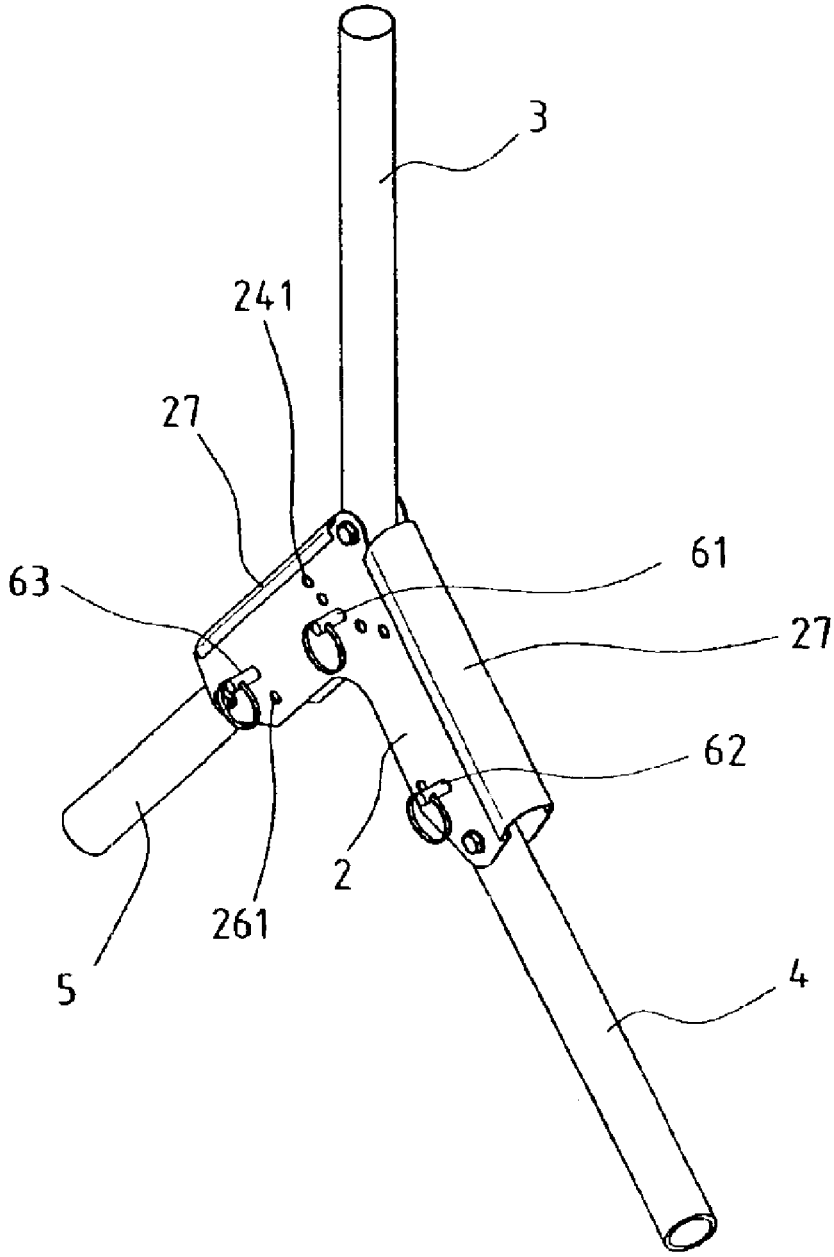
FIG. 1 is a perspective view showing the connection member and the three tubes of the bouncing net device of the present invention.
Figure 2:
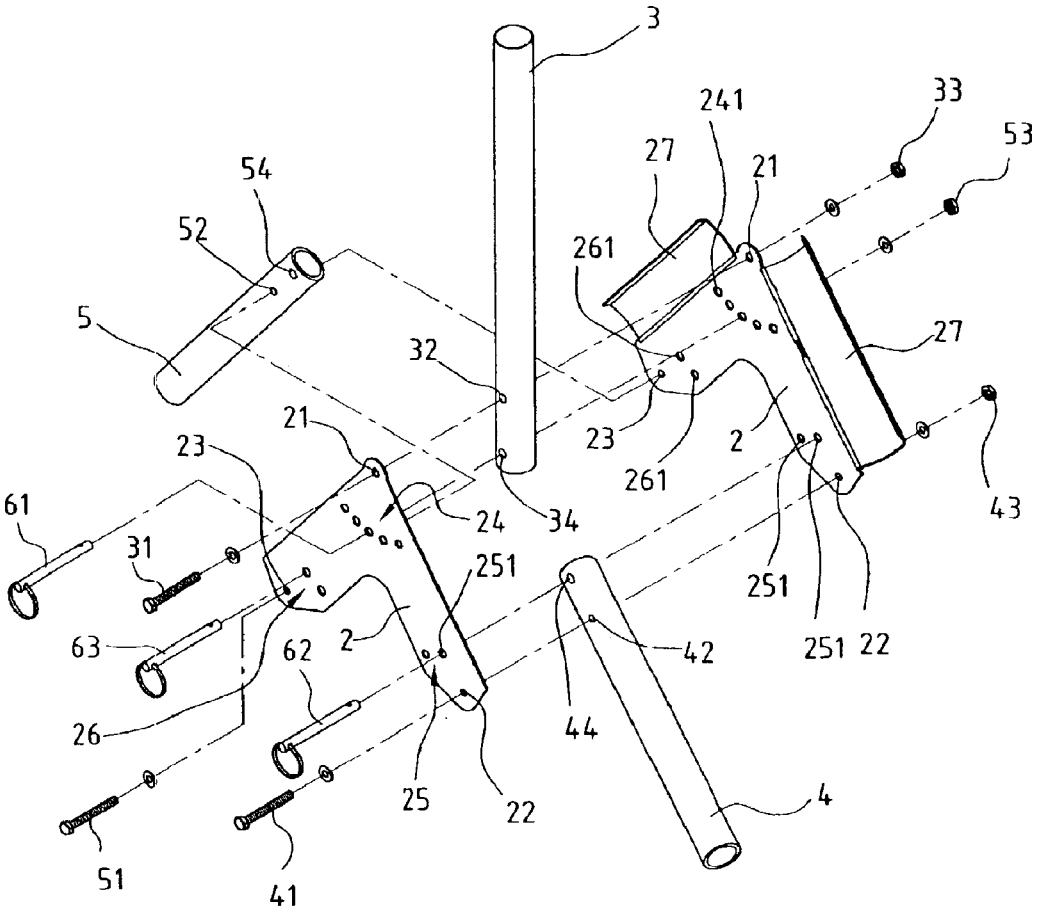
FIG. 2 is an exploded view showing the connection member and the three tubes of the bouncing net device of the present invention.
Figure 3:
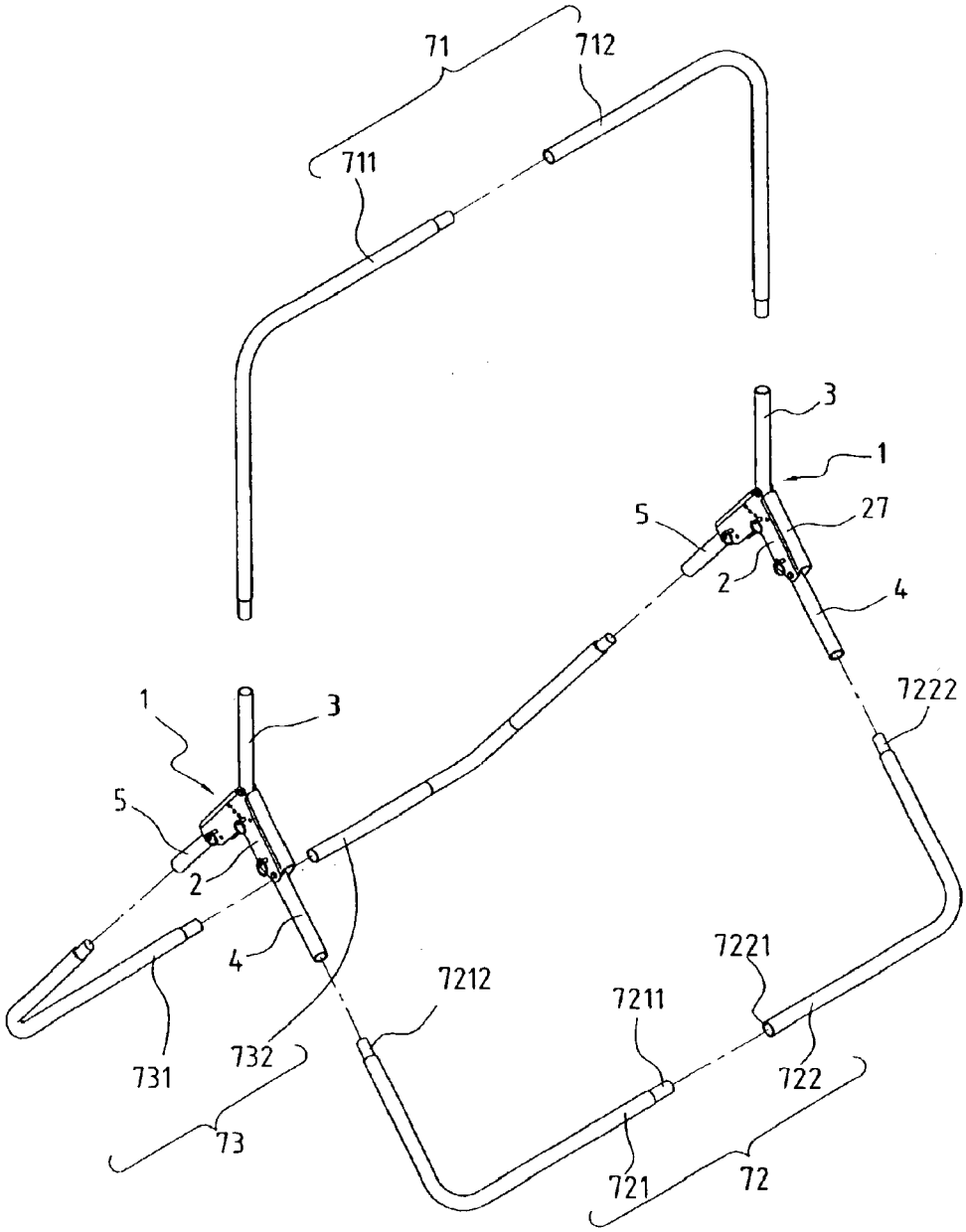
FIG. 3 is an exploded view showing two sets of the connection members with three tubes and three frames.
Figure 4:
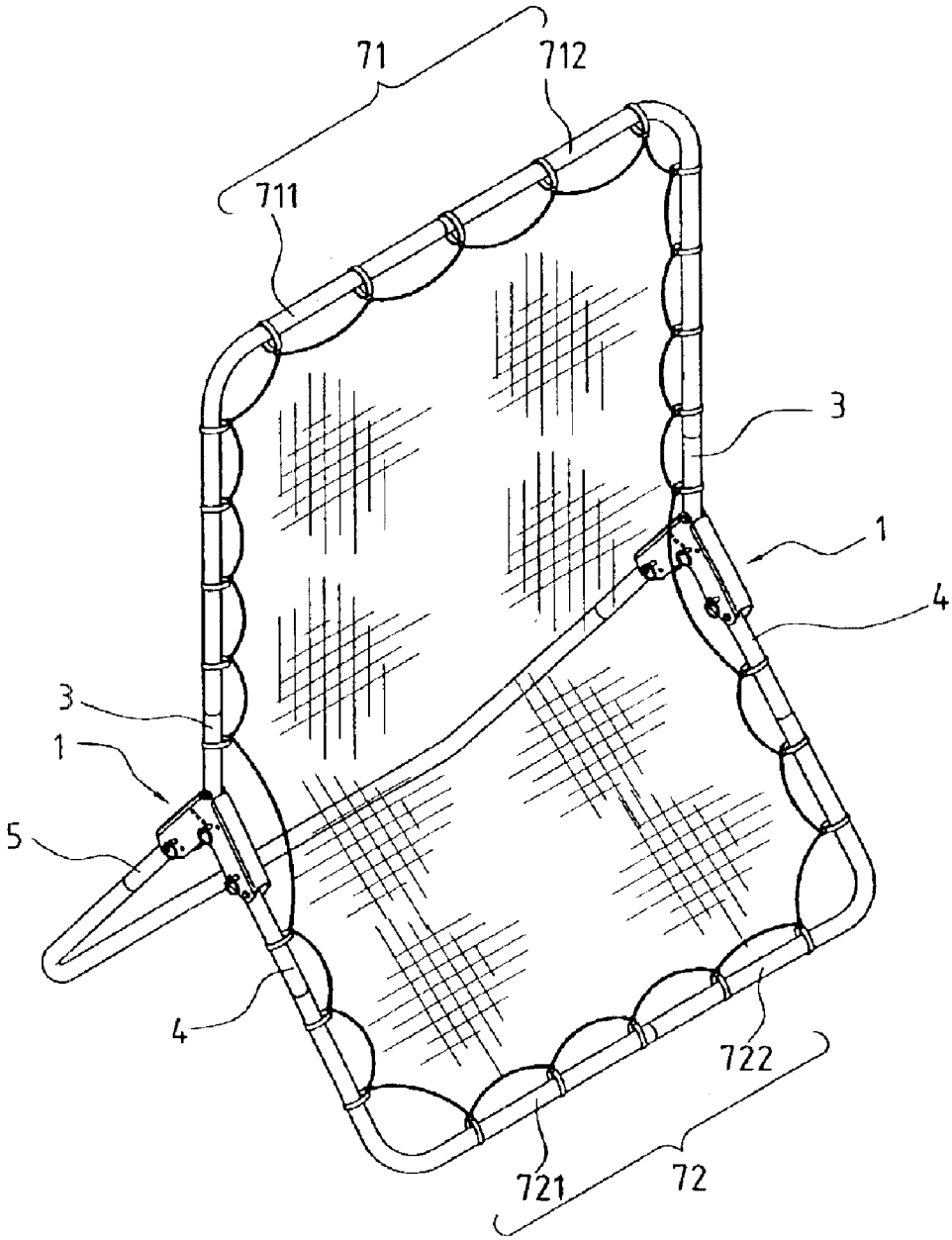
FIG. 4 is a perspective view showing the bouncing net device of the present invention.
Figure 5:
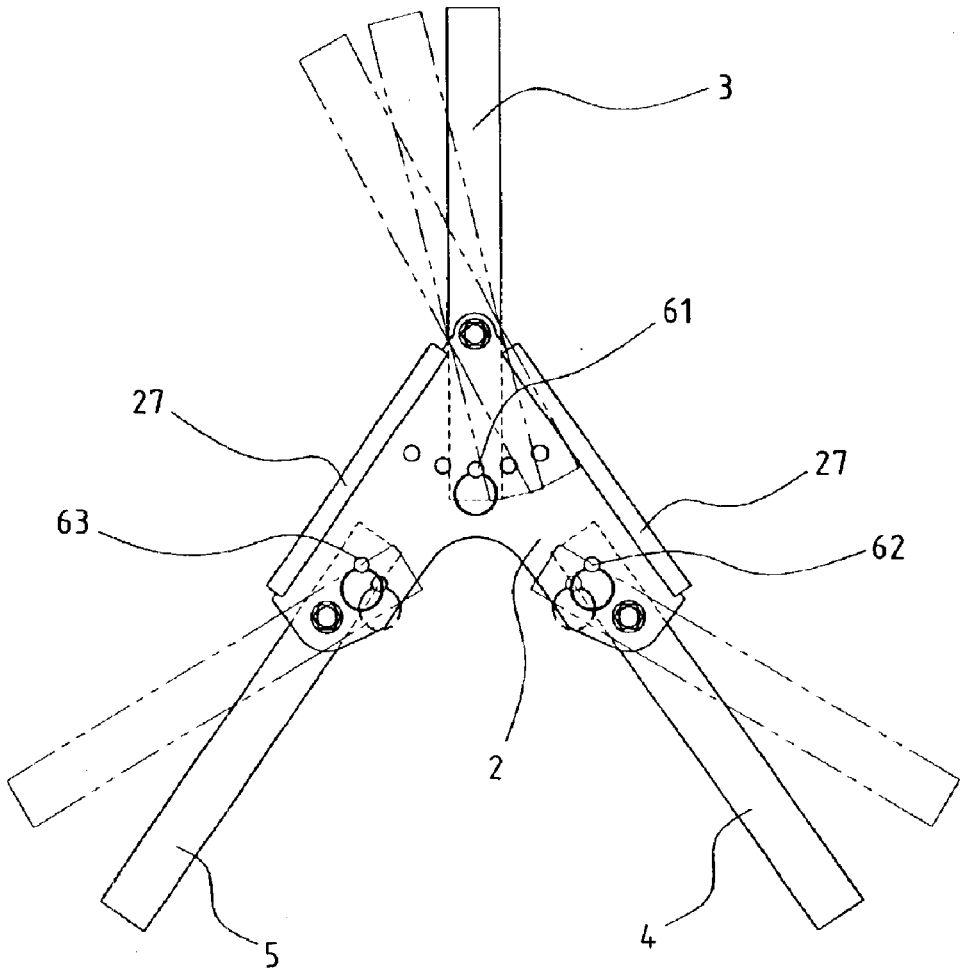
FIG. 5 shows the tubes can be pivoted relative to the connection member.

Three tubes 3, 4, 5 are pivotably connected between the two parts 2 by extending one of the bolts 31, 41, 51 through the respective connection holes 21, 22, 23 and the combining holes 32, 42, 52 defined through the tubes 3, 4, 5. The bolts 31, 41 and 51 are engaged with three respective nuts 33, 43, 53. Each of the tubes 3, 4, 5 further has a position hole 34, 44, 54 and three pins 61, 62, 63, which extend through one 241, 251, 261 of the positioning holes 24, 25, 26 and the position holes 34, 44, 54 so that the angle of the three tubes 3, 4, 5 can be adjusted relative to the connection member 1 as shown in FIG. 5 by different positioning holes 24, 25, 26.

Three frames 71, 72, 73 are respectively connected between the three tubes 3, 4, 5 on the two connection members 1. Each of the three frames 71, 72, 73 is composed of two L-shaped partitions 711, 712; 721, 722; and 731, 732 and each L-shaped partition 711, 712; 721, 722; and 731, 732 includes an insertion 7211/7222 and an open end 7212/7221. Taking the frame 72 as an example, the L-shaped partition 721 has two insertions 7211, 7212 and the other L-shaped partition 722 has an insertion 7222 and an open end 7221. The two insertions 7212, 7222 of the two partitions 721, 722 are inserted in the tubes 4, 4 respectively, and the insertion 7211 is inserted in the open end 7221 to from a U-shaped frame 72. The frame 72 is connected to the two tubes 4, 4 by inserting the two insertions 7212, 7222 into the tubes 4, 4.

Two covers 27 are pivotably connected to two side wings of one of the two parts 2 and cover up a gap between the two parts 2. Strings are tied on the frames 71, 72, 73 and the tubes 3, 4, 5 to form a net.

Figure 6:
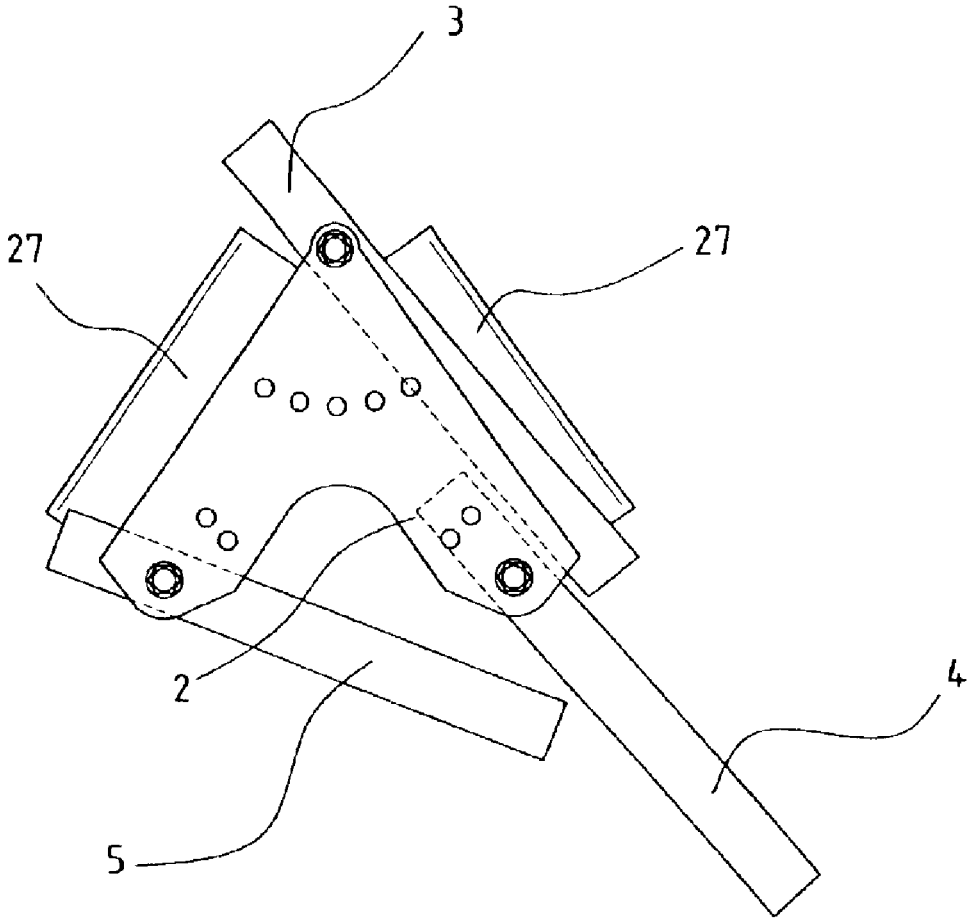
FIG. 6 shows the three tubes are folded relative to the connection members.
Figure 7:
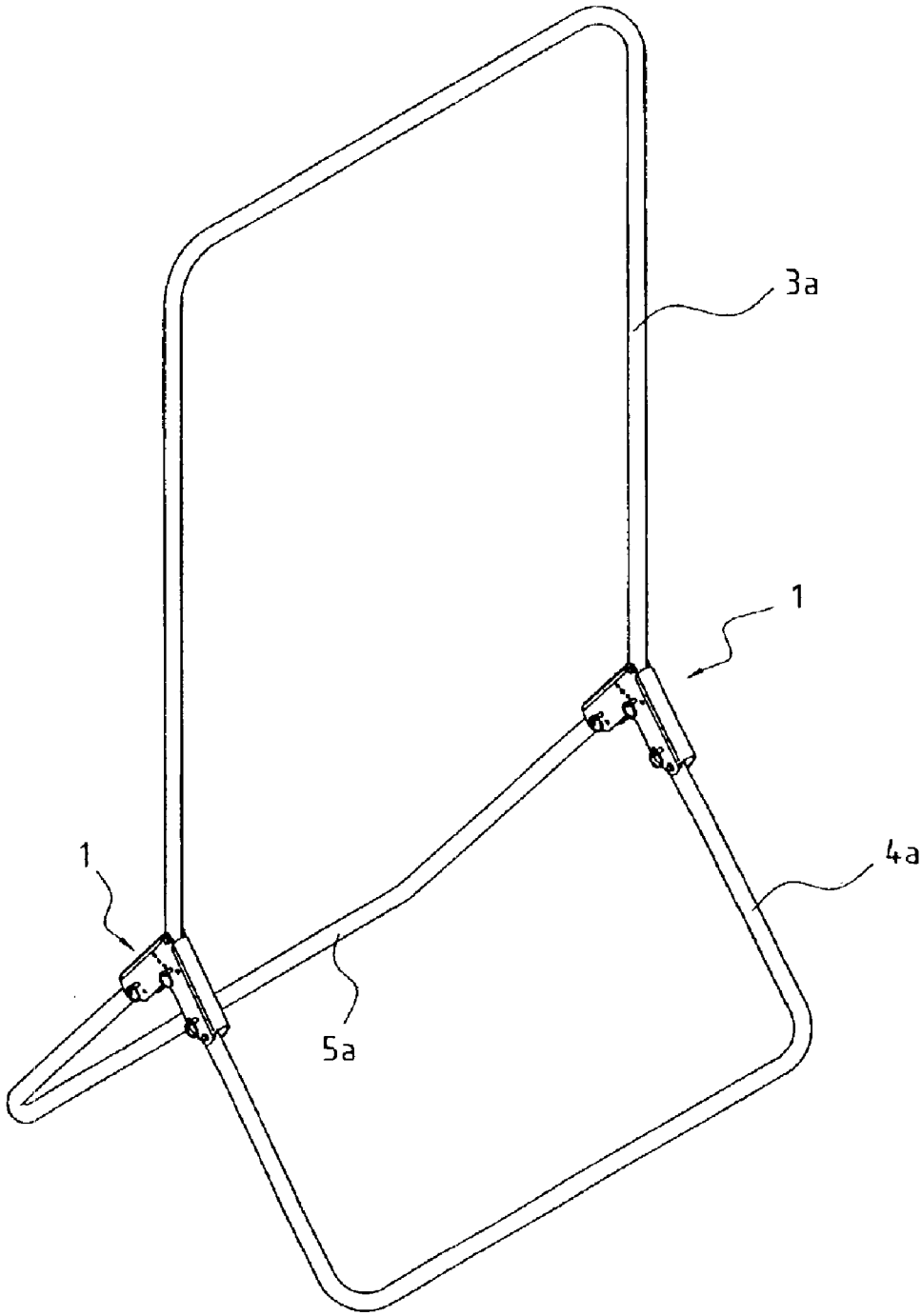
FIG. 7 shows another type of frame of the bouncing net device of the present invention.

As shown in FIG. 6, the tubes 3, 4, 5 can be folded between the two parts 2 with the covers 27 are opened. The covers 27 become a stop to prevent the tubes 3, 4, 5 from suddenly pivoting because of the tension force of the strings when adjusting the angles of the tubes 3, 4, 5 such that the users' fingers can be protected. FIG. 7 shows the length of the frames 3*a*, 4*a*, 5*a* can be different.

Figure 8:
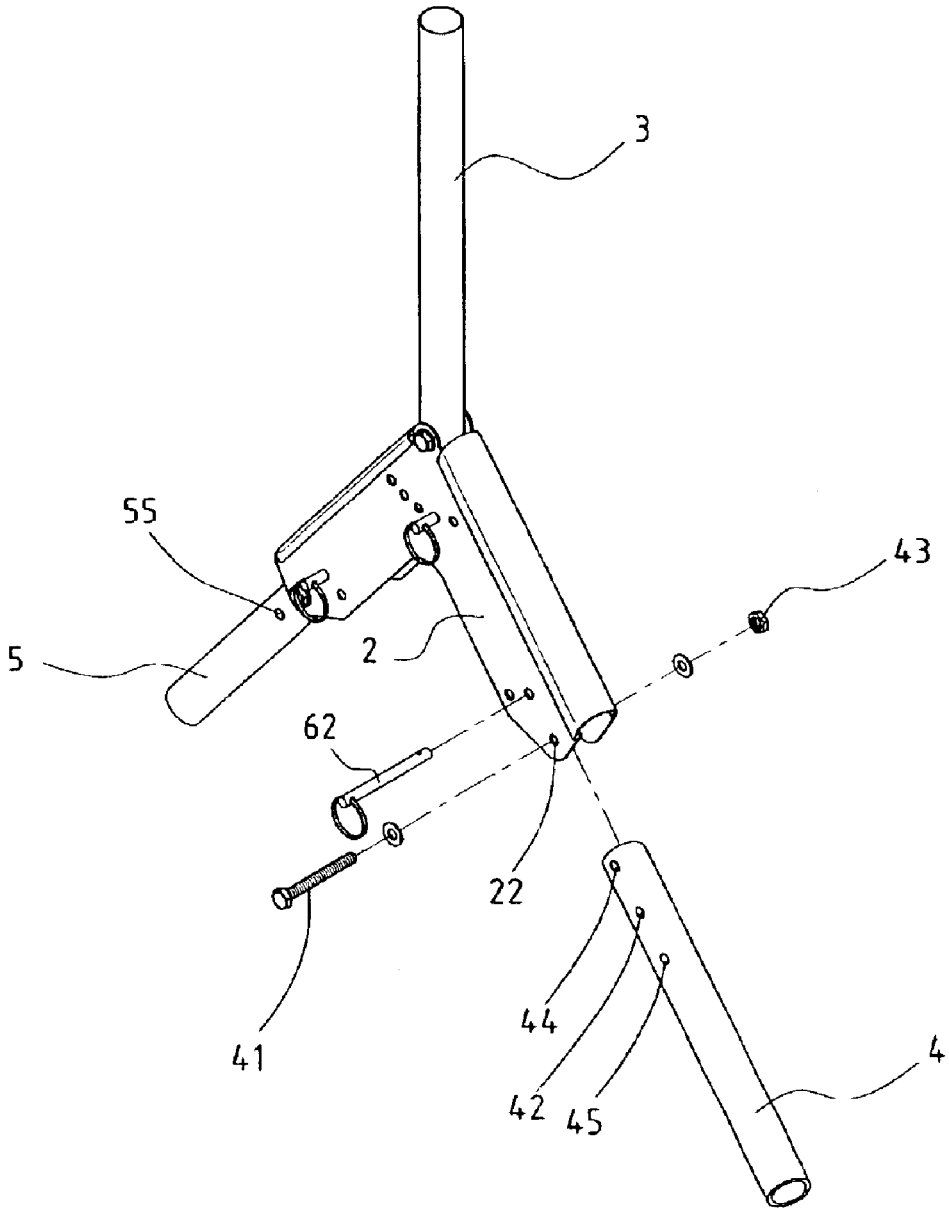
FIG. 8 is an exploded view showing another embodiment of the tubes and the connection member.
Figure 9:
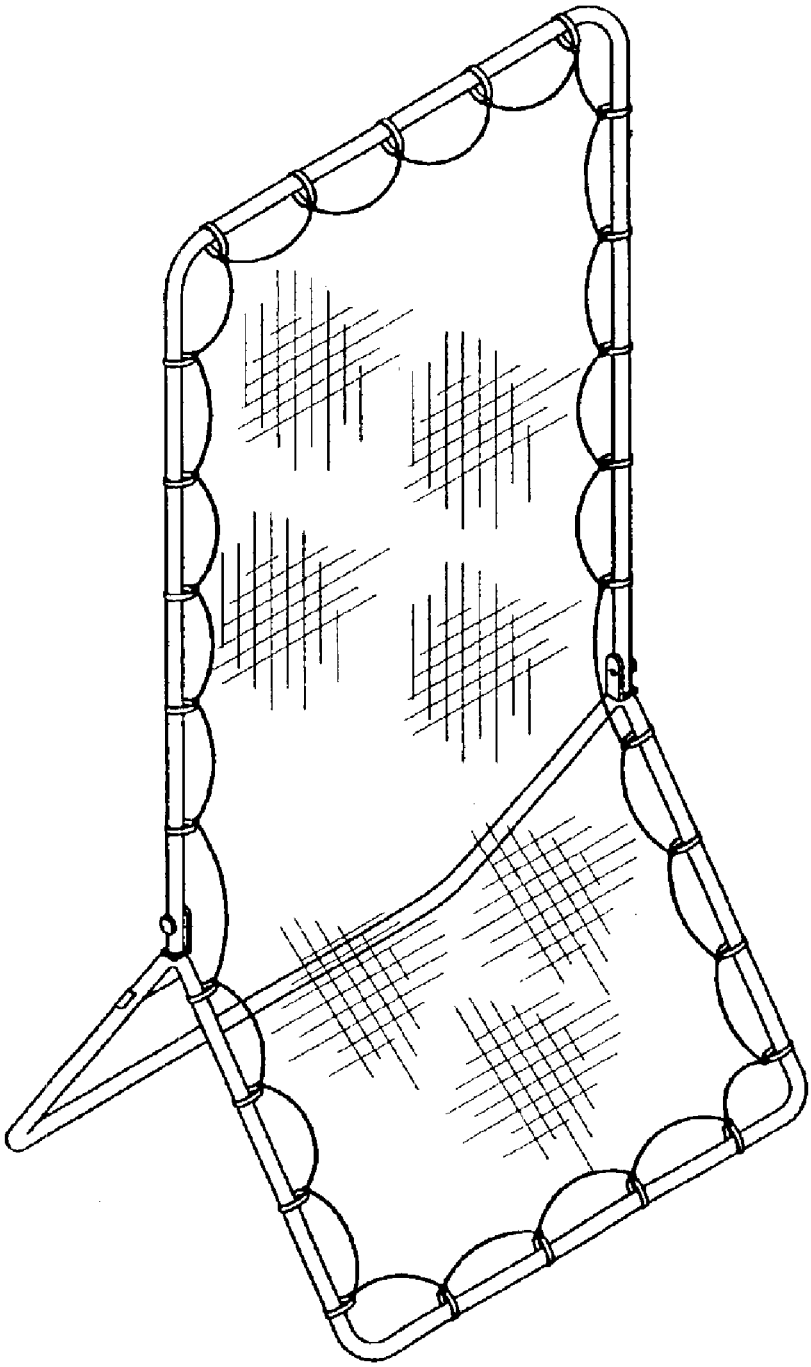
FIG. 9(PRIOR ART)
FIG. 9 shows a conventional bouncing net device.

Referring to FIG. 8, each of the three tubes 3,4,5 further includes an adjusting hole 45 and the respective combining holes 32, 42 and 52 are located at an intermediate point between the position hole 44 and the adjusting hole 45. By this arrangement, the tube 4 can be further pushed into the side wing and employs the adjusting hole 45 as the combining hole to receive the bolt 41, and the combining hole 42 is used as the position hole to receive the pin 62. This can adjust the length of the frames.

While we have shown and described the embodiment in accordance with the present invention, it should be clear to those skilled in the art that further embodiments may be made without departing from the scope of the present invention.

What is claimed is:

1. A bouncing net device comprising:

two connection members each comprising two identical parts and three tubes pivotably connected between the two parts, each of the connection members having three sets of positioning holes which are located around positions where the three tubes are pivotably connected to the connection member;

three frames respectively connected between the three tubes on the two connection members, two ends of each frame inserted into the tubes corresponding thereto, and two covers are pivotably connected to two sides of one of the two parts and covering up a gap between the two parts.

2. The bouncing net device as claimed in claim 1, wherein each of the two parts includes two side wings extending inclined downward from a peak portion and the three tubes are pivotably connected to the peak portion and the two side wings.

3. The bouncing net device as claimed in claim 1, wherein each of the three tubes includes a combining hole for being pivotably connected to the connection member, a position hole through which a pin extends through one of the positioning holes, and an adjusting hole, the combining hole located at an intermediate point between the position hole and the adjusting hole.

4. The bouncing net device as claimed in claim 1 wherein each of the three frames is composed of two L-shaped partitions.

5. The bouncing net device as claimed in claim 4 wherein one of the two L-shaped partition includes two insertions and the other L-shaped partition includes an insertion and an open end, the two partitions connected with each other by inserting one of the insertions of one partition with the open end of the other partition, the frame connected between the two corresponding tubes on the two connection members by inserting the two insertions into the two tubes.

6. The bouncing net device as claimed in claim 3, wherein the positioning holes are located at a radius about the combining hole.

* * * * *